US006586665B1

(12) United States Patent
Liao et al.

(10) Patent No.: US 6,586,665 B1
(45) Date of Patent: Jul. 1, 2003

(54) DRUM HAVING A MEMBRANE ADJUSTABLE TO DIFFERENT TENSIONS

(76) Inventors: Pi Hu Liao, No. 63-11, An Mei Road, Gon Guan Tsuen, Hou Li Hsiang, Taichung Hsien (TW), 421; Ming Kuon Wang, No. 2, Li Feng Road, Chong Ho Tsuen, Hou Li Hsiang, Taichung Hsien (TW), 421

( * ) Notice: Subject to any disclaimer, the term of this patent is extended or adjusted under 35 U.S.C. 154(b) by 0 days.

(21) Appl. No.: 10/050,381

(22) Filed: Jan. 18, 2002

(51) Int. Cl.[7] ..... G10D 13/02
(52) U.S. Cl. ..... 84/411 R
(58) Field of Search ..... 84/411 R, 413, 84/411 A, 417

(56) References Cited

U.S. PATENT DOCUMENTS 4,330,124 A 5/1982 Vettorello ..... 273/67 B
5,025,697 A * 6/1991 May ..... 84/411 R
5,517,890 A * 5/1996 Cooperman ..... 84/411 R
5,739,448 A * 4/1998 Toscano ..... 84/413
6,069,307 A * 5/2000 Rogers ..... 84/411 R

* cited by examiner

*Primary Examiner*—Shih-Yung Hsieh
(74) *Attorney, Agent, or Firm*—Charles E. Baxley

(57) ABSTRACT

A drum includes a cylindrical drum member having a chamber formed by an inner peripheral surface, a ring engaged with the inner peripheral surface of the drum member, and a membrane engaged onto the drum member and having a peripheral skirt secured onto the drum member. Two blocks are secured to the edges of the ring and each has an inclined inner surface, a follower is engaged between the inclined inner surfaces of the blocks and is forced to move relative to the blocks and to force the blocks toward and away from each other, in order to adjust the tension of the membrane.

5 Claims, 6 Drawing Sheets

DRUM HAVING A MEMBRANE ADJUSTABLE TO DIFFERENT TENSIONS

BACKGROUND OF THE INVENTION

1. Field of the Invention

The present invention relates to a drum, and more particularly to a drum having a structure for adjusting the membrane to different tensions.

2. Description of the Prior Art

Typical drums comprise a membrane secured onto a cylindrical body. U.S. Pat. No. 4,330,124 to Vettorello discloses one of the typical drums and also includes a membrane secured onto a cylindrical body with a rim. However, once the membrane has been secured onto the cylindrical body, the tension of the membrane may not be easily adjusted.

The present invention has arisen to mitigate and/or obviate the afore-described disadvantages of the conventional drums.

SUMMARY OF THE INVENTION

The primary objective of the present invention is to provide a drum including a structure for adjusting the membrane to different tensions.

In accordance with one aspect of the invention, there is provided a drum comprising a cylindrical drum body including a chamber formed therein and defined by an inner peripheral surface, and including an upper portion, and including an outer peripheral portion, a ring engaged in the upper portion of the drum body and engaged with the inner peripheral surface of the drum body, a membrane engaged onto the upper portion of the drum body, and including a peripheral skirt secured onto the outer peripheral portion of the drum body, and means for adjusting the ring to tension and to release the membrane. The tension of the membrane may thus be adjusted when the ring is tension or released.

The ring includes two edges, the adjusting means includes means for moving the edges of the ring toward and away from each other to tension and to release the membrane.

The moving means includes two blocks secured to the edges of the ring, and means for forcing the blocks toward and away from each other to tension and to release the membrane.

The blocks each includes an inclined inner surface facing toward each other, the forcing means includes a follower engaged between the inclined inner surfaces of the blocks, and means for actuating the follower to move relative to the blocks and to force the blocks toward and away from each other.

The adjusting means includes a screw hole formed in the follower, and a fastener engaged through the upper portion of the drum body and threaded with the screw hole of the follower, for moving the follower relative to the blocks when the fastener is rotated relative to the drum body.

The blocks each includes an outer portion having a groove formed therein for receiving the edges of the ring respectively.

The blocks each includes a base surface engaged with the inner peripheral surface of the drum body, and an end portion distal to the base surface thereof, the adjusting means includes a plate secured to the end portions of the blocks. The plate includes two ends each having a flap folded therefrom for engaging with the blocks respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
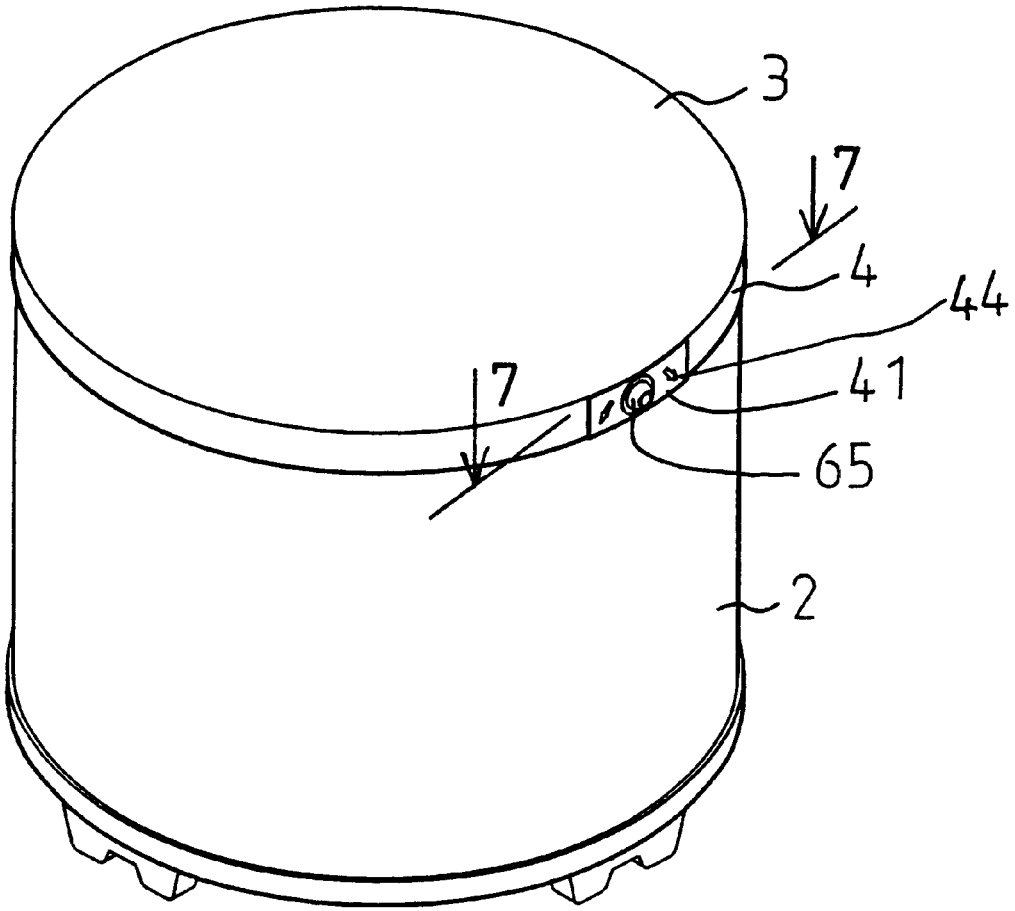
FIG. 1 is a perspective view of a drum in accordance with the present invention.
Figure 2:
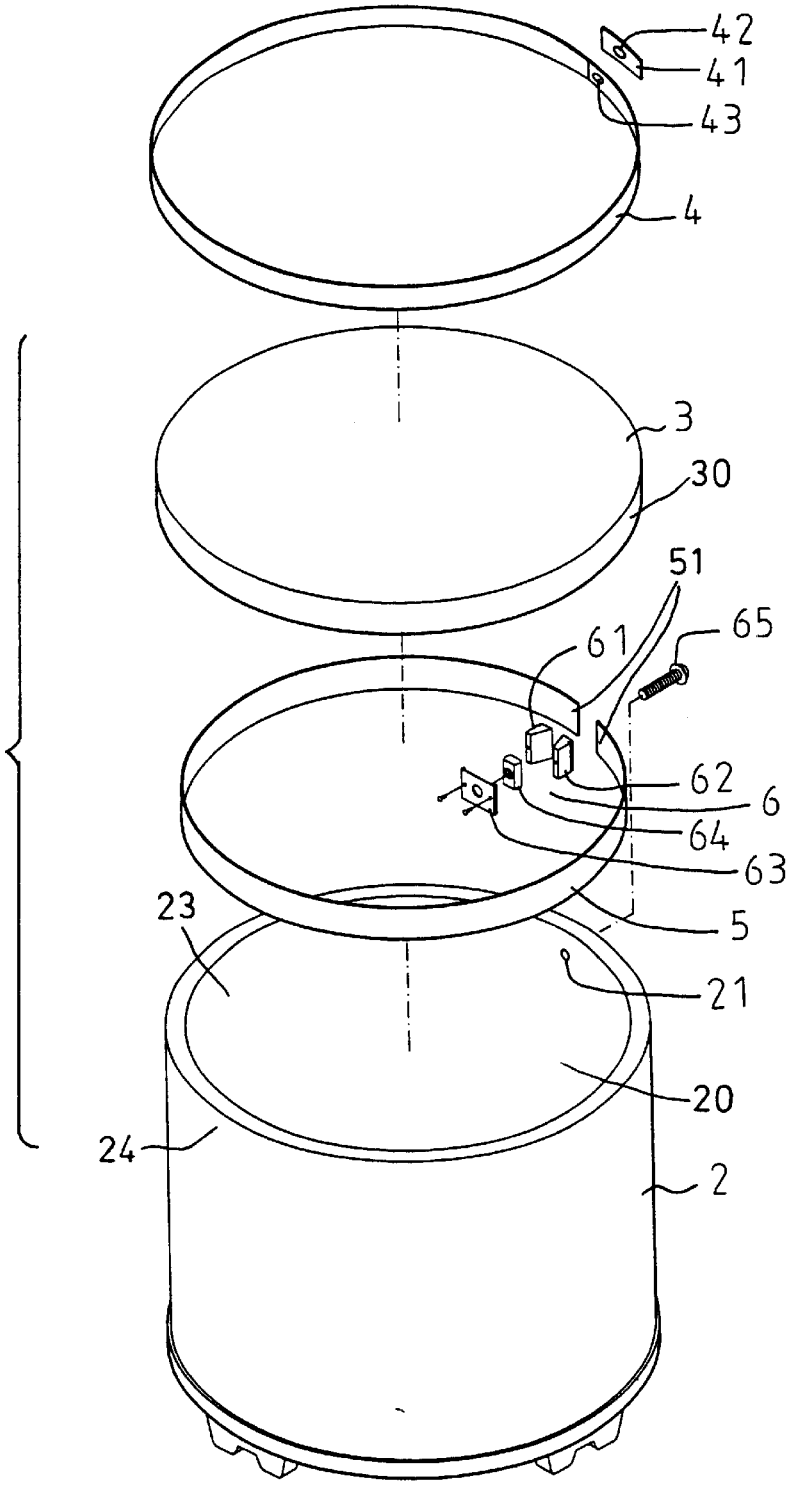
FIGS. 2, 3, 4 are partial exploded views of the drum.
Figure 3:
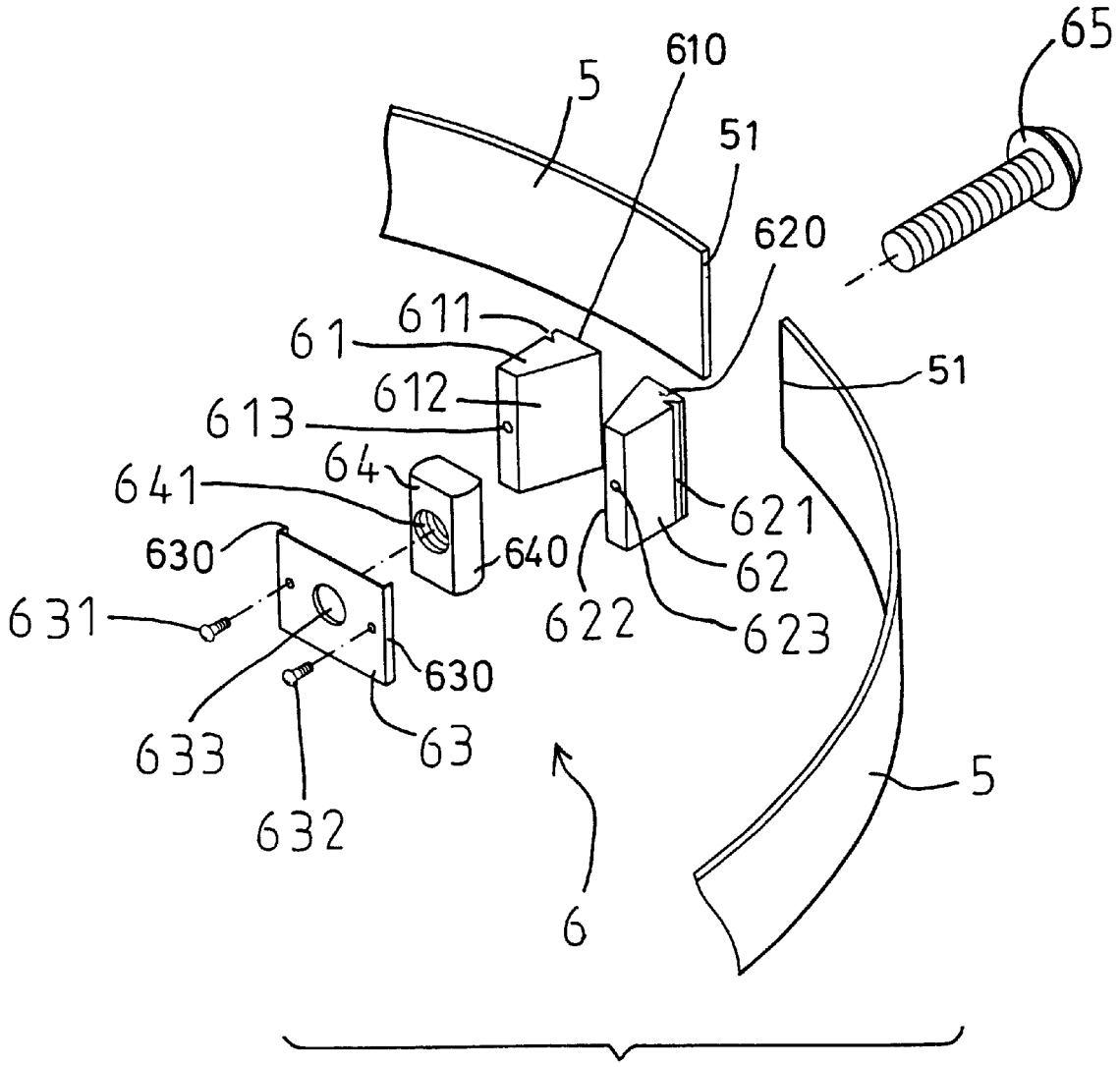
Figure 4:
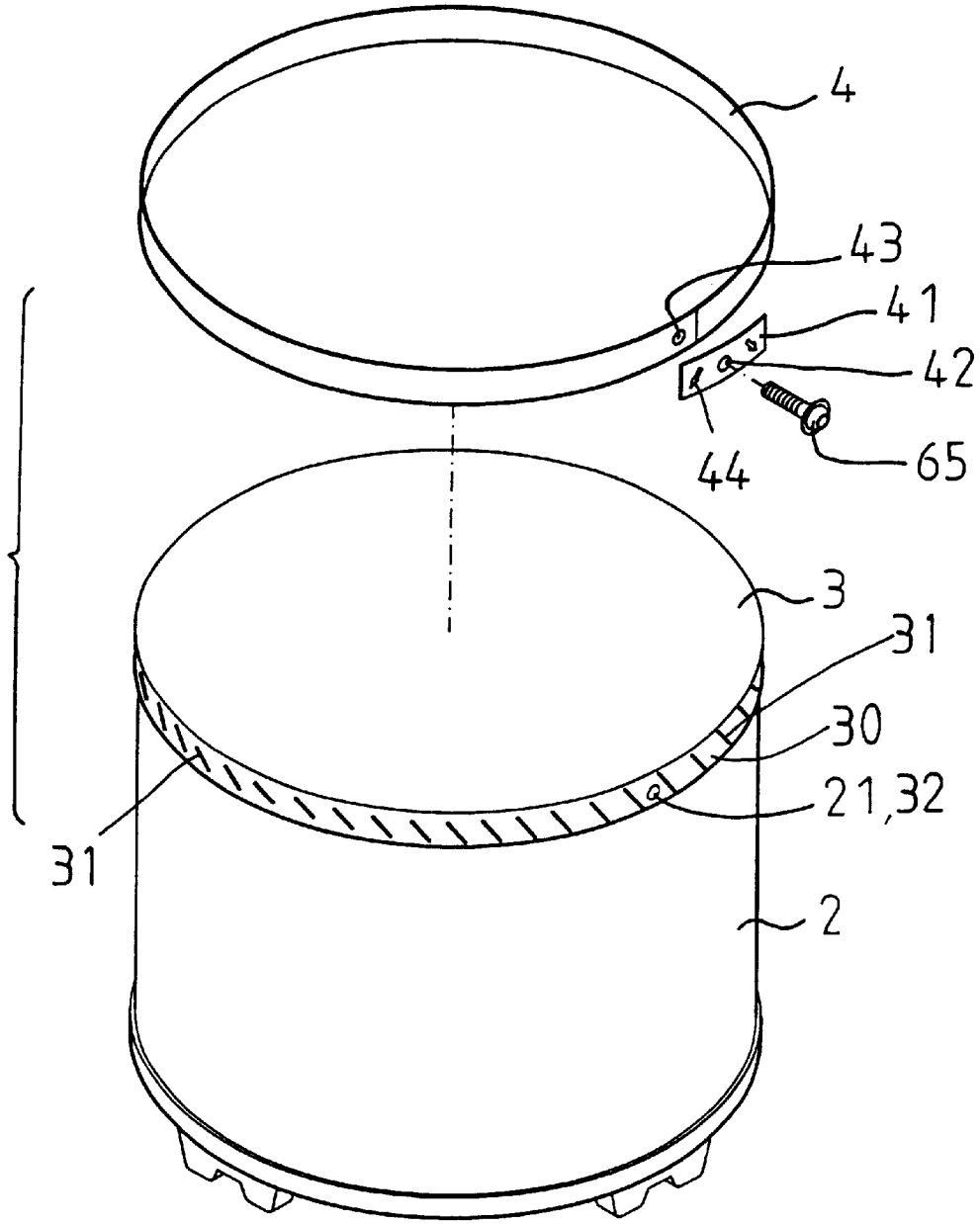
Figure 6:
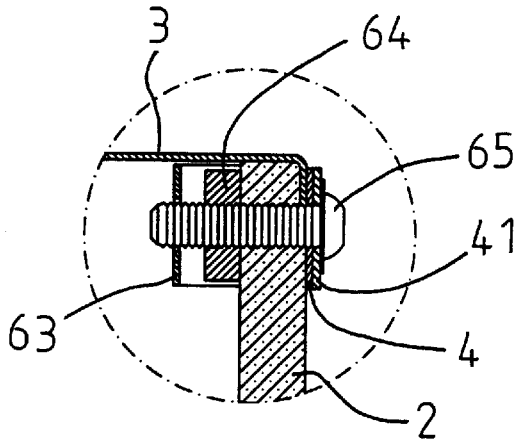
FIG. 6 is an enlarged partial cross sectional view of the drum.
Figure 5:
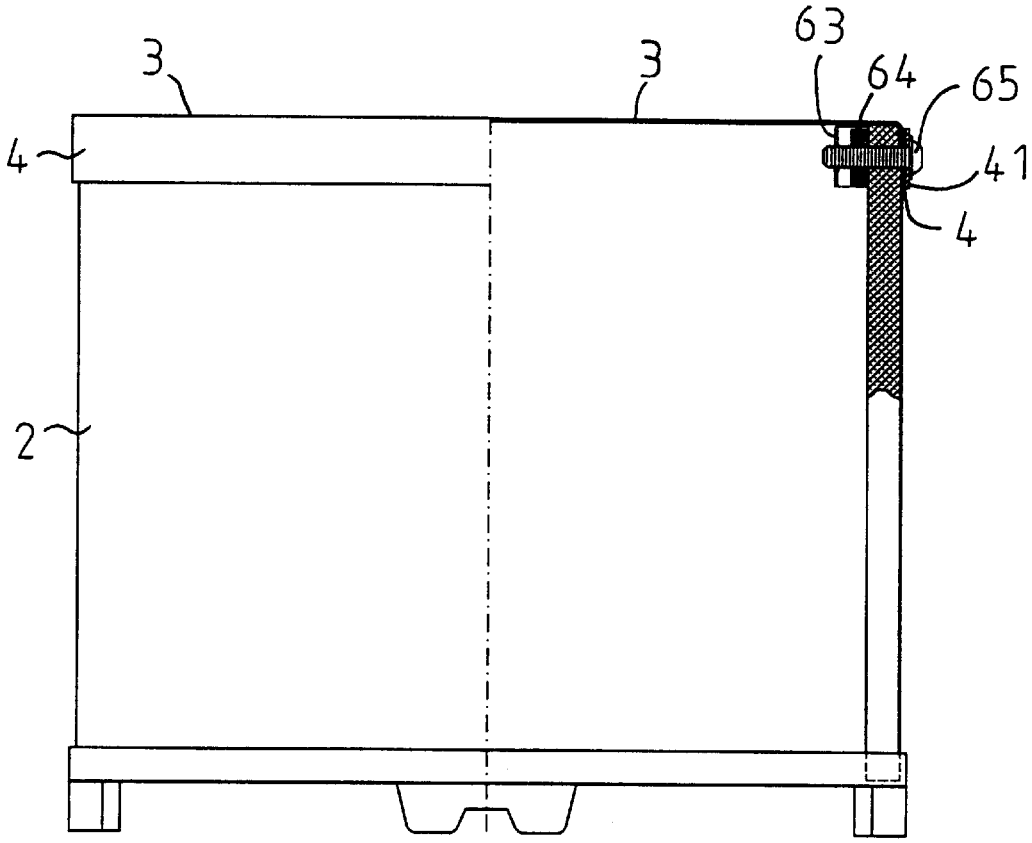
FIG. 5 is a plan schematic view of the drum, in which one half of the drum has been cut off for showing the inner structure of the drum.

Referring to the drawings, and initially to FIGS. 1–7, a drum in accordance with the present invention comprises a cylindrical drum body 2 including a chamber 20 formed therein and formed or defined by an inner peripheral surface 23, and including an orifice 21 formed in the upper peripheral portion 24 thereof. A spring blade or a ring 5 is received in the upper portion of the chamber 20 of the cylindrical drum body 2, and engaged with the inner peripheral surface 23 of the drum body 2, and is preferably made of steel or the other resilient or spring members or materials, and includes two edges 51.

An adjusting device 6 includes two blocks 61, 62 each having a flat bottom or flat base surface 610, 620 engaged onto or engaged with the inner peripheral surface 23 of the drum body 2, and each having a groove 611, 621 formed or provided in the outer portion thereof for receiving the edges 51 of the ring 5 respectively. The blocks 61, 62 each includes a tapered or inclined inner surface 612, 622 inclined relative to the base surface 610, 620 thereof, and each includes an end portion distal or opposite to the base surface 610, 620 thereof and having a screw hole 613, 623 formed therein. A plate 63 is engaged onto the end portions of the blocks 61, 62 and includes two ends each having a flap 630 bent or folded therefrom for engaging with the outer portions of the blocks 61, 62 respectively. Two fasteners 631, 632 are engaged through the plate 63 and threaded with the screw holes 613, 623 of the blocks 61, 62 for securing the plate 63 to the end portions of the blocks 61, 62.

A wedge or a follower 64 is disposed between the blocks 61, 62, and includes two sides 640 engaged with the inclined inner surfaces 612, 622 of the blocks 61, 62, and includes a screw hole 641 formed therein for threading with a bolt or a fastener 65. The plate 63 includes an opening 633 formed therein for receiving the fastener 65, best shown in FIGS. 5–9. The follower 64 may be caused or forced to move relative to the inclined inner surfaces 612, 622 of the blocks 61, 62, and may be moved or adjusted away from the plate 63 for forcing the blocks 61, 62 away from each other to tension the ring 5, or may be moved or adjusted toward the plate 63 for allowing the blocks 61, 62 to be moved toward each other and to release the ring 5.

A membrane 3 is engaged onto the upper portion of the cylindrical drum body 2, and includes the peripheral portion of the peripheral skirt 30 folded and engaged onto the outer and upper peripheral portion 24 of the cylindrical drum body 2, and secured to the drum body 2 with staples 31 or the like. The membrane 3 includes an aperture 32 formed in the peripheral skirt 30 thereof and aligned with the orifice 21 of the drum body 2 for receiving the fastener 65. A rim 4 is engaged onto the peripheral skirt 30 of the membrane 3 for shielding the peripheral skirt 30 of the membrane 3 or for decorative purposes. The rim 4 includes a hole 43 formed therein and aligned with the aperture 32 of the membrane 3 and the orifice 21 of the drum body 2.

A panel 41 is engaged onto the coupling portion of the two end portions thereof, or engaged onto the hole 43 of the rim 4, and includes a hole 42 formed therein and aligned with the hole 43 of the rim 4 and the aperture 32 of the membrane 3 and the orifice 21 of the drum body 2 for receiving the fastener 65. The fastener 65 is engaged through the hole 42 of the panel 41 and the hole 43 of the rim 4 and the aperture 32 of the membrane 3 and the orifice 21 of the drum body 2, and is threaded with the screw hole 641 of the follower 64, such that the fastener 65 may be rotated relative to the drum body 2 to move the follower 64 toward or away from the plate 63 and to adjust the blocks 61, 62 to tension or to release the ring 5.

Figure 7:
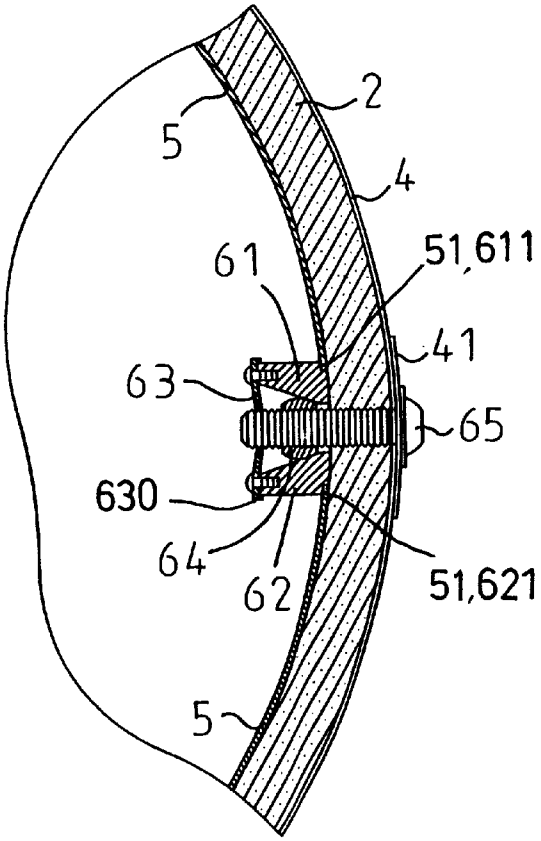
FIG. 7 is a partial cross sectional view taken along lines 7—7 of FIG. 1.
Figure 8:
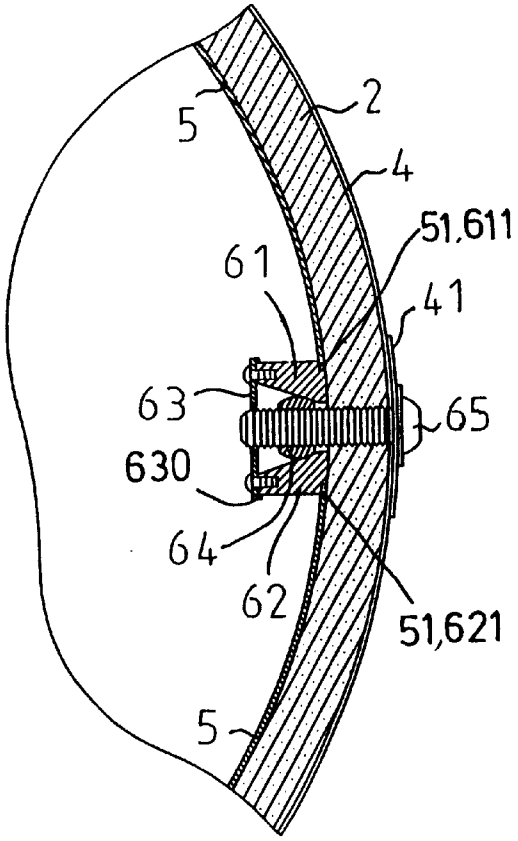
FIGS. 8, 9 are partial cross sectional views similar to FIG. 7, illustrating the operation of the drum.
Figure 9:
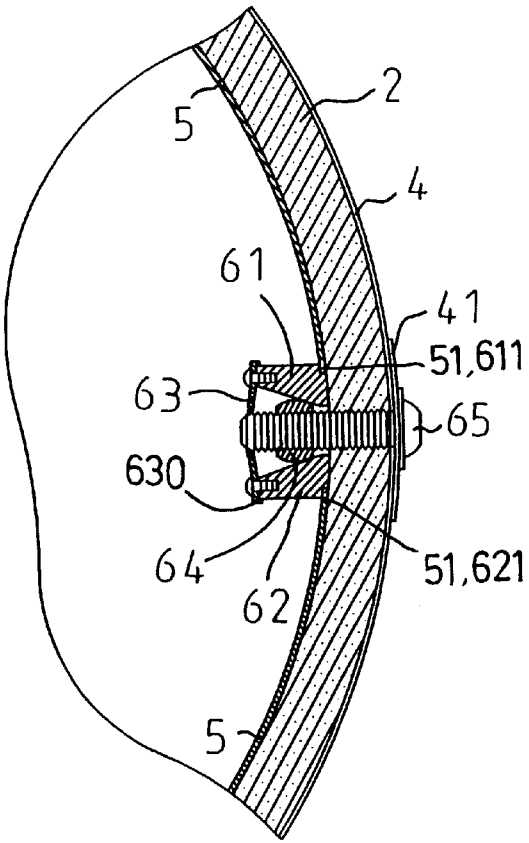

In operation, as shown in FIGS. 7–9, when the follower 64 is forced or moved toward the plate 63 or away from the inner peripheral surface 23 of the drum body 2 or away from the ring 5, the blocks 61, 62 may be moved or biased toward each other by the ring 5, such that the ring 5 may be released, and the membrane 3 may also be released, or the tension of the membrane 3 may be decreased. On the contrary, when the follower 64 is forced or moved away from the plate 63 or toward the inner peripheral surface 23 of the drum body 2 or toward the ring 5, the follower 64 may be moved relative to the inclined inner surfaces 612, 622 of the blocks 61, 62, and the blocks 61, 62 may be moved and forced away from each other to tension the ring 5, and to tension or expand the upper peripheral portion 24 of the cylindrical drum body 2 and thus to tension the membrane 3, such that the membrane 3 may be tensioned, or the tension of the membrane 3 may be increased.

Accordingly, the drum in accordance with the present invention includes a structure for adjusting the membrane to different tensions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A drum comprising:

a cylindrical drum body including a chamber formed therein and defined by an inner peripheral surface, and including an upper portion, and including an outer peripheral portion, a ring engaged in said upper portion of said drum body and engaged with said inner peripheral surface of said drum body, said ring including two edges, a membrane engaged onto said upper portion of said drum body, and including a peripheral skirt secured onto said outer peripheral portion of said drum body, and means for adjusting said ring to tension and to release said membrane, said adjusting means including means for moving said edges of said ring toward and away from each other to tension and to release said membrane, said moving means including two blocks secured to said edges of said ring, and means for forcing said blocks toward and away from each other to tension and to release said membrane, said blocks each including an inclined inner surface facing toward each other, said forcing means including a follower engaged between said inclined inner surfaces of said blocks, and means for actuating said follower to move relative to said blocks and to force said blocks toward and away from each other.

2. The drum according to claim 1, wherein said adjusting means includes a screw hole formed in said follower, and a fastener engaged through said upper portion of said drum body and threaded with said screw hole of said follower, for moving said follower relative to said blocks when said fastener is rotated relative to said drum body.

3. A drum comprising:

a cylindrical drum body including a chamber formed therein and defined by an inner peripheral surface, and including an upper portion, and including an outer peripheral portion, a ring engaged in said upper portion of said drum body and engaged with said inner peripheral surface of said drum body, said ring including two edges, a membrane engaged onto said upper portion of said drum body, and including a peripheral skirt secured onto said outer peripheral portion of said drum body, and means for adjusting said ring to tension and to release said membrane, said adjusting means including means for moving said edges of said ring toward and away from each other to tension and to release said membrane, said moving means including two blocks secured to said edges of said ring, and means for forcing said blocks toward and away from each other to tension and to release said membrane, said blocks each including an outer portion having a groove formed therein for receiving said edges of said ring respectively.

4. A drum comprising:

a cylindrical drum body including a chamber formed therein and defined by an inner peripheral surface, and including an upper portion, and including an outer peripheral portion, a ring engaged in said upper portion of said drum body and engaged with said inner peripheral surface of said drum body, said ring including two edges, a membrane engaged onto said upper portion of said drum body, and including a peripheral skirt secured onto said outer peripheral portion of said drum body, and means for adjusting said ring to tension and to release said membrane, said adjusting means including means for moving said edges of said ring toward and away from each other to tension and to release said membrane, said moving means including two blocks secured to said edges of said ring, and means for forcing said blocks toward and away from each other to tension and to release said membrane, said blocks each includes a base surface engaged with said inner peripheral surface of said drum body, and an end portion distal to said base surface thereof, said adjusting means includes a plate secured to said end portions of said blocks.

5. The drum according to claim 4, wherein said plate includes two ends each having a flap folded therefrom for engaging with said blocks respectively.

* * * * *